United States Patent [19]

Flanagan

[11] B 4,011,534

[45] Mar. 8, 1977

[54] MAGNETIC RELAY

[75] Inventor: Charles D. Flanagan, Dallas, Tex.

[73] Assignee: Texas Instruments Incorporated, Dallas, Tex.

[22] Filed: Nov. 25, 1974

[21] Appl. No.: 526,654

[44] Published under the second Trial Voluntary Protest Program on March 23, 1976 as document No. B 526,654.

[52] U.S. Cl. ..... 335/186; 335/164

[51] Int. Cl.² ..... H01H 45/00

[58] Field of Search ..... 335/186, 164, 165, 166, 335/167, 169, 170

[56] References Cited

UNITED STATES PATENTS

| | | | |
|---|---|---|---|
| 1,971,199 | 8/1934 | Owens | 335/169 |
| 2,685,012 | 7/1954 | Coulson | 335/170 |
| 2,811,601 | 10/1957 | Somers | 335/170 |
| 3,864,650 | 2/1975 | Evans | 335/186 |
| 3,864,651 | 2/1975 | Flanagan | 335/186 |

*Primary Examiner*—Harold Broome

*Attorney, Agent, or Firm*—John A. Haug; James P. McAndrews; Russell E. Baumann

[57] ABSTRACT

A magnetic relay incorporating an electrical interlock function along with a bypass function in which the bypass function needs to be manually set, operates once in a cycle, and is trip free.

13 Claims, 14 Drawing Figures

MAGNETIC RELAY

CROSS-REFERENCES TO RELATED APPLICATIONS

This application relates to subject matter disclosed and claimed in copending application Ser. No. 421,889, entitled "Manually Set Switching Device", filed Dec. 5, 1973, now U.S. Pat. No. 3,893,054 copending application Ser. No. 421,903, entitled "Manually Set Magnetic Relay", filed Dec. 5, 1973, now U.S. Pat. No. 3,864,650 and copending application Ser. No. 421,902, entitled "Manually Set Magnetic Relay", filed Dec. 5, 1973, now U.S. Pat. No. 3,864,651 the copending applications having the same assignee as the present application.

BACKGROUND OF THE INVENTION

This invention relates to the field of electrical relays and more particularly, is related to a single-cycle magnetic relay in an electrical interlock system which must be manually set prior to each operation.

It is well known to provide electrical interlocks in systems to prevent operation unless specific conditions have been met. For example, as a safety measure in automobiles, the ignition system may be disabled until the driver and all of his passeners have fastened their seat belts. To implement such a system, an electrical interlock operated by sensors or switches sequentially set by the driver and passengers entering the car and fastening the belts may be provided in the ignition system of the automobile. Unless the belts are fastened after entry, the interlock disables the ignition system and the engine cannot be started.

It will be recognized that a failure of the electrical interlock system may completely disable the ignition system and prevent operation of the automobile. Such a situation may not only be frustrating to the driver and his passengers but also could prove to be a serious hazard particularly in an emergency situation in which the automobile must be moved.

To remedy the situation and eliminate the possible hazards posed by the electrical interlock, an override or bypass relay has been installed to bypass the electrical interlock. The relay should be of the type that requires manual resetting before each override operation and located in a position not readily accessible to the driver. Current designs of bypass relays have been successful but there is always a desire to have a relay and system that is more reliable and inexpensive.

Accordingly, it is an object of the present invention to disclose a highly reliable manually set magnetic relay which automatically disables itself when deenergized to limit its use to a single-cycle or one-time operation. It is a further object to disclose a device which includes a bypass relay function along with an electrical interlock relay function. It is yet another object to disclose a relay which is of simple, rugged and economical construction. Other objects and features will be in part apparent and in part pointed out hereinafter.

The present invention resides in a manually settable magnetic bypass relay which includes two sets of contacts which perform two separate functions.

The magnetic relay comprises a set of normally closed contacts which act as the load switch for the electrical interlock, a set of normally open contacts which when closed act as the bypass, a cantilevered flexible clapper arm and latch spring which move in response to an electromotive force and on which one of the normally closed contacts is positioned, a manually operable actuator which closes the set of normally open contacts, and an electromagnetic coil which is serially connected electrically to the interlock logic module. If a sequence of events occurs in a predetermined proper order, i.e. the fastening of the seat belt after a person is seated in the car, no signal is sent from an interlock logic module to open the load switch and therefore cut off the power from the starter motor. However, if the sequence occurs in the wrong order the interlock logic module sends a signal to energize the coil upon attempting to start the car which causes the clapper arm and latch spring to move in response to the electromotive force and open the normally closed interlock load contacts so the car can not be started.

The bypass system of this relay can override the load switch of the electrical interlock when the load switch is in the open contacts position by providing a parallel circuit which can be manually actuated. The manual pressing of the actuator closes the normally open bypass contacts and completes the circuit. Subsequent energization of the coil when starting the car causes the clapper and, in turn, bypass contacts to move from a first latch position to a second latch position so that upon deenergization of the coil the contacts separate and go back to the normally open position.

In the accompanying drawings, in which several embodiments of the invention are illustrated:

DESCRIPTION OF THE PREFERRED EMBODIMENTS

Figure 1:
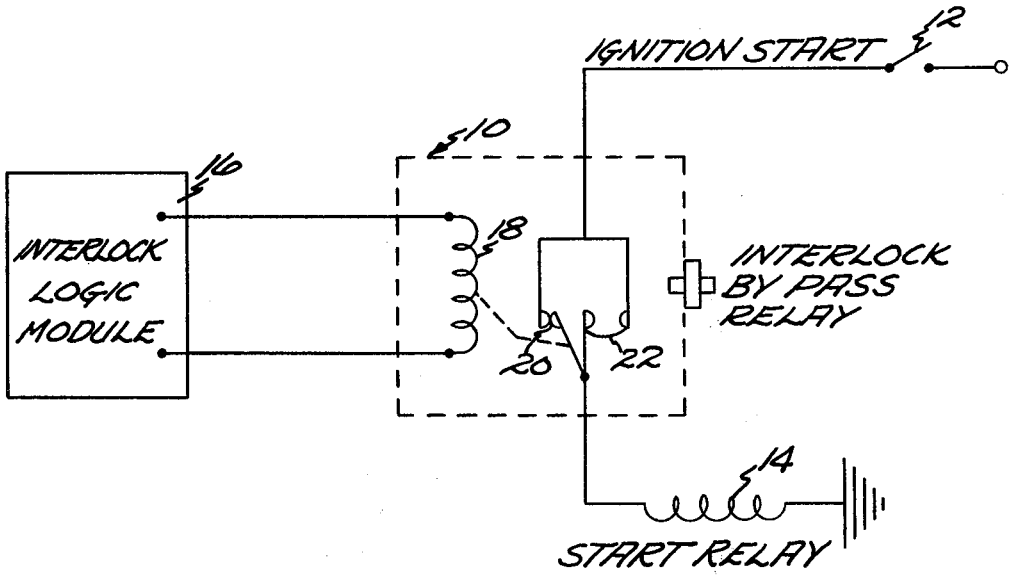
FIG. 1 is an electrical schematic diagram illustrating one system in which the manually set magnetic relay of the present invention may be employed.

FIG. 1 is an electrical diagram showing schematically the combination interlock-bypass relay of the present invention in the starting circuitry of an automobile. The interlock-bypass relay prevents energization of the electrical starter motor unless the seat belts have been properly fastened in each of the occupied seats of the automobile or the bypass has been manually actuated. It should be understood that the interlock-bypass relay can be employed in other environments to which its operation is suited.

The interlock-bypass relay of the present invention generally designated by the numeral 10, is connected serially in the electrical starting circuit between the start switch 12, which as shown in FIG. 1 may be incorporated in a single switching device manually operated by means of the ignition key, and the start relay 14. The ignition-start switch 12 is connected to the plus terminal of the battery (not shown) and the start relay is connected to the ground terminal through the frame of the automobile. The energization of the ignition-start switch also energizes other portions of the electrical system such as the spark coil, fuel pumps and instrumentation needed during operation of the engine.

The seat belt interlock-bypass system includes a logic module 16 and the interlock-bypass system includes a logic module 16 and the interlock-bypass relay 10. The logic module 16 receives signals from sensing switches indicating which seats of the automobile are occupied and which seat belts have been fastened. If the seats are first occupied and then the respective seat belts are fastened in that order, no signal issues from the module 16 to actuate the coil 18 and the normally closed interlock relay contacts 20 remain in the closed position so the car can be started. If the logic module detects an unfastened seat belt in one of the occupied seats, or if the sensing switches are not actuated in the proper order indicating, for example, a permanently buckled seat belt, the coil 18 is energized which opens the normally closed interlock relay contacts 20 and prevents energization of the start relay unless the bypass relay contacts 22 are manually closed to provide an alternate current path.

Figure 2:
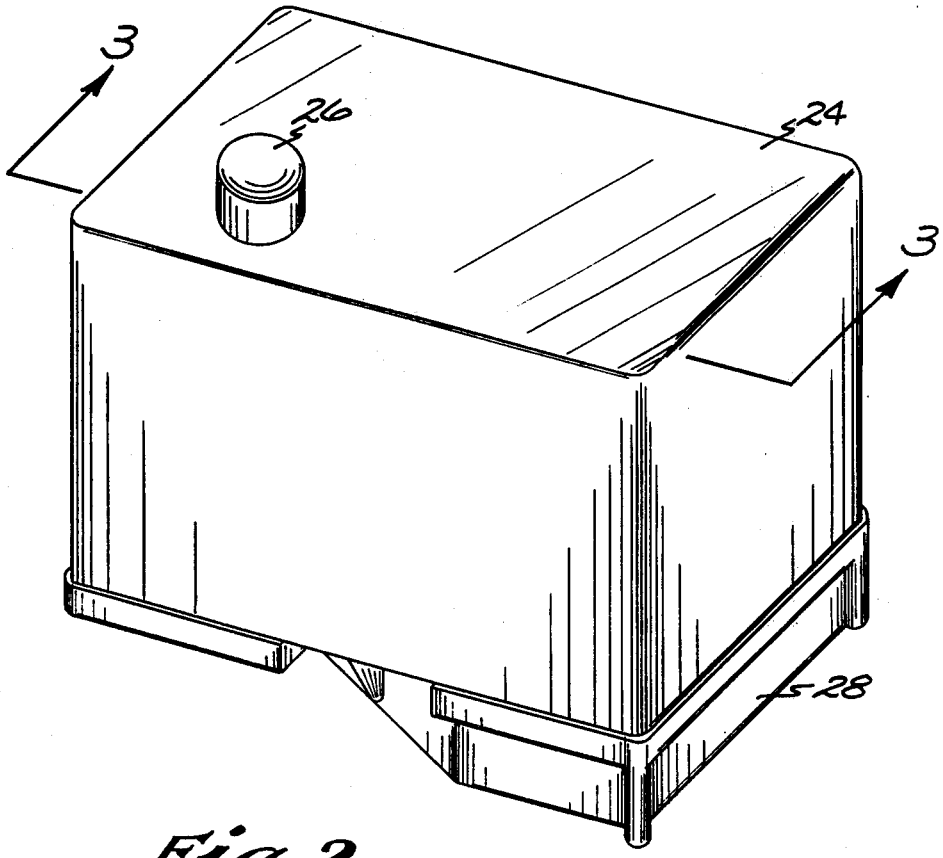
FIG. 2 is a perspective view of an interlock bypass relay built in accordance with the invention.

As seen in FIG. 2 the interlock-bypass relay has an outside casing 24 which may be conveniently made out of metal with a hole in the top surface which receives the manual reset bypass button 26. Depressing button 26 causes closure of bypass relay contacts 22 to be discussed in greater detail below. Casing 24 is secured to a base 28 of the relay in any conventional manner as by staking. Base 28 is made of an electrically insulating material such as phenolic resin.

Figure 3:
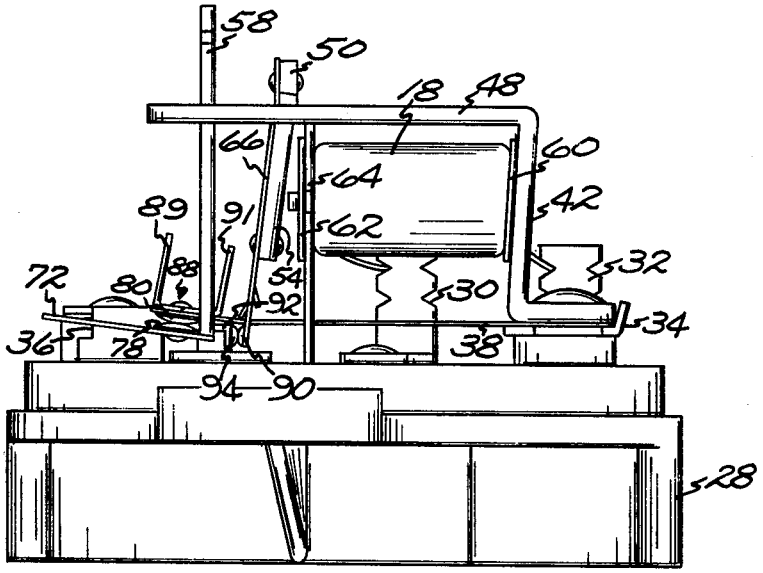
FIG. 3 is a cross-sectional view taken along section line 3—3 of FIG. 2 with the top casing removed and with the bypass switch and interlock contacts in the closed position.
Figure 4:
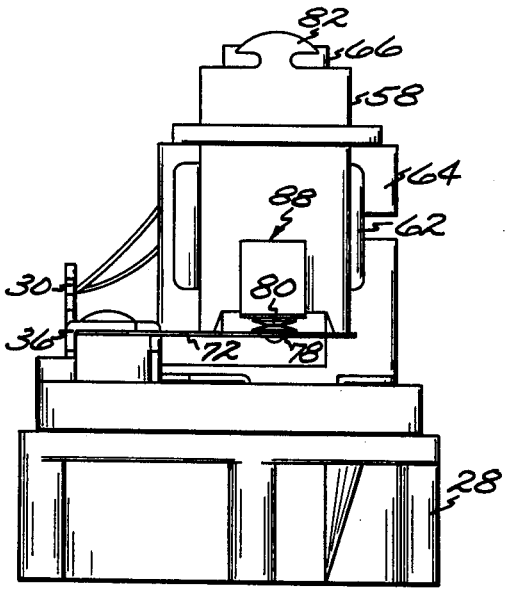
FIG. 4 is a left side elevation view of the relay shown in FIG. 3.

As shown in FIG. 3 base 28 has two coil terminals 30 and 32 mounted in the base which act to connect the logic module 16 to the coil 18. The base also has two load terminals 34 and 36 which serve to connect ignition-start switch 12 and the start relay. The current has two parallel paths to travel between load terminal 34 and load terminal 36 which will be explained more fully below.

Figure 7:
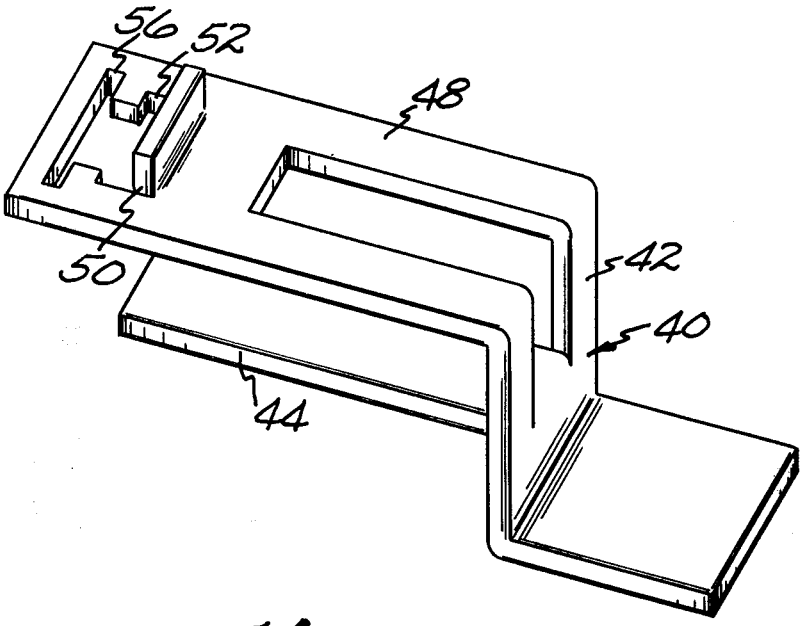
FIG. 7 is a perspective view of a frame member used in the relay of FIGS. 2–6.
Figure 12:
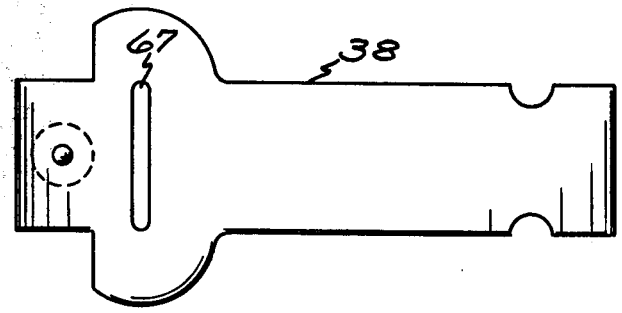
FIG. 12 is a plan view of the bypass movable contact arm used in the relay of FIGS. 2–6.

In stacked relation on top of load terminal 34 are a movable contact arm 38, as best shown in FIG. 12 for the bypass part of the relay, and a frame 40. These two elements of the relay along with the terminal 34 are firmly attached to the base 28 as by a rivet. The movable contact arm 38 extends in cantilever relation from the load terminal 34 and has a movable contact 80 attached at the opposite distal end. Frame 40 as shown in FIG. 7 may be formed of a single piece of suitable material exhibiting magnetic properties such as low carbon steel and has right angle bends at the top and bottom of a straight verticle portion 42. In addition, at a point about half way up the verticle portion 42 a center rectangular piece 44 of the frame is cut on three sides so that this piece can be bent at a right angle in relation to portion 42 to form the core 44 of the coil 18. The coil is made in a conventional manner and need not be discussed further here. A top portion 48 of the frame also has a rectangular piece 50 which is cut on three sides and bent up 90° in relation to the plane of the top portion 48. This top rectangular piece 50 along with a first slot 52 formed in the frame by cutting piece 50 therefrom cooperate to receive and position a clapper 54 to be discussed further below. A second slot 56 positioned between the first slot 52 and the end of the top portion 48 is provided for receiving a slide 58 which will likewise be discussed in detail below.

An electrically insulating rectangular member 60, shown in FIG. 3, is positioned on core 44 prior to winding to insulate the coil windings from the verticle portion 42 and to act as an end stop. A similar member 62 is positioned on the other end of core 44 and, along with a frame member 64 which supports core 44, anchors the coil 18. The lower portion of the frame member 64 has a rectangular opening to allow passage and free movement of the movable contact arm 38 which runs through it.

Figure 8:
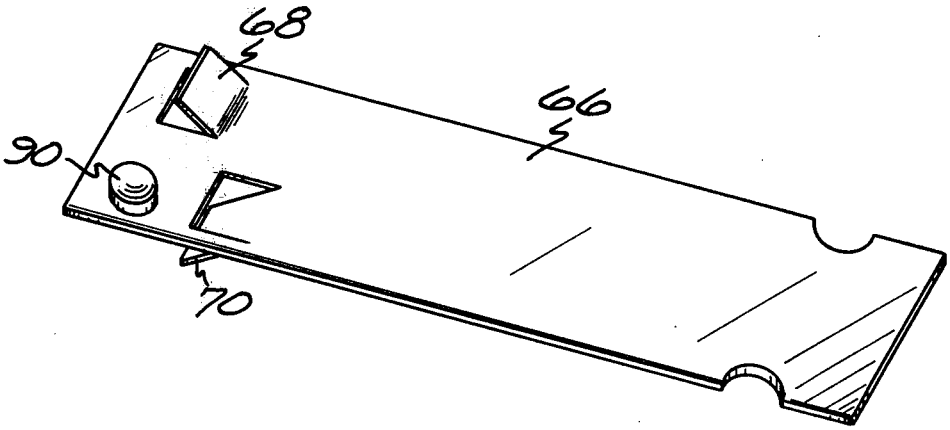
FIG. 8 is a perspective view of a latch spring used in the relay of FIGS. 2–6.

A latch spring 66 as shown in FIG. 8, made of material having good spring characteristics such as stainless steel is attached at one end to the top piece 50 and at a point intermediate its ends to a clapper 54. Clapper 54 made of suitable magnetic material such as low carbon steel is disposed on a surface of spring 66 and is positioned in the first slot 52 in the top portion 48 of frame 40 contiguous to the coil 18. This sytem of attachment of the latch spring 66 to top rectangular piece 50 and to clapper 54 allows the latch spring 66 and clapper 54 to pivotally move toward and away from the coil 18 upon energization and deenergization thereof. Latch spring 66 may be attached to top piece 50 and clapper 54 by means of rivets (not shown).

Latch spring 66 extends through a long transversely extending narrow rectangular slit 67, as shown in FIG. 12, in movable contact arm 38. On each of two opposite faces of the latch spring 66 there is a tab or latch 68, 70 cut on three sides and bent up at an angle of preferably under 45 degrees which serve as latches for the bypass part of the relay. The first latch 68 on the side away from the coil is closer to the bottom of the latch spring 66 than the second latch 70 on the other side.

Figure 10:
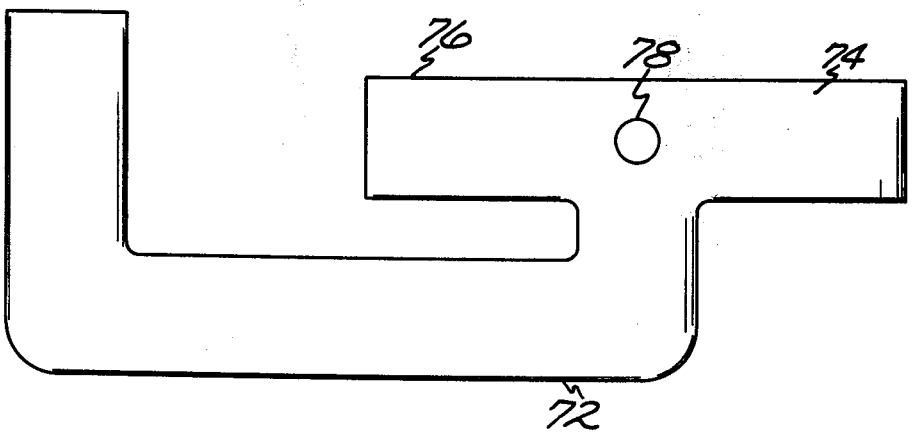
FIG. 10 is a plan view of a bypass relatively stationary contact arm used in the relay of FIGS. 2–6.

A relatively stationary contact arm 72, as shown in FIG. 10, for the bypass portion of the relay is generally U-shaped with two ears 74 and 76 at the stationary contact end. Arm 72 has one end connected to load terminal 36 and the other slightly movable end positioned in relation to movable arm 38 so that a stationary contact 78 attached to the relatively stationary arm 72 will be engaged by the movable contact 80 upon depression of movable contact arm 38.

Figure 9:
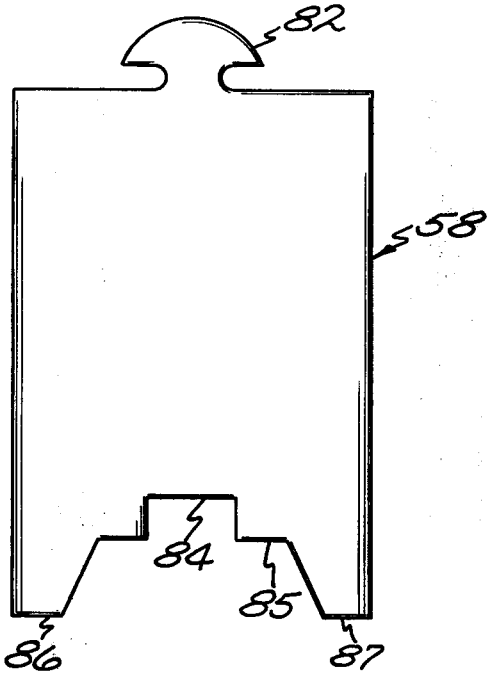
FIG. 9 is a front elevation view of a slide member used in the relay of FIGS. 2–6.

Movable contact arm 38 is depressed by manually pushing the button 26 extending out of the top casing 24 which causes a slide 58 best shown in FIG. 9 provided with a top plug 82, press-fitted into the button 26 to likewise move. Slide 58 fits in the second slot 56 of the frame top 48 and has a first notched out center portion 84 to allow clearance for movable contact 80 and a second notched out portion 85 in which the movable contact arm is disposed. Bottom leg portions 86, 87 of slide 58 initially just making contact with the ear portions 74, 76 of the U-shaped stationary contact arm 72 when the button is unactuated, cause the arm to move downwardly when the button 26 is depressed preventing the closure of contacts 78, 80. Thus, as long as the button remains fully depressed contacts 78, 80 will be open. This feature makes the device trip-free so that even if the button is permanently depressed as by tapeing, the system will not be overridden. As soon as the pressure is removed from the button, the movable contact arm 38 is latched in position by latch 68 and the depressed relatively stationary contact arm 72 comes back to its normal position with contacts 78, 80 in engagement. A U-shaped spring 88 can be used for better guiding of the slide 58 upon actuation with the two ear portions 89, 91 serving as positive stops to lateral movement of the slide as viewed in FIG. 3.

Figure 5:
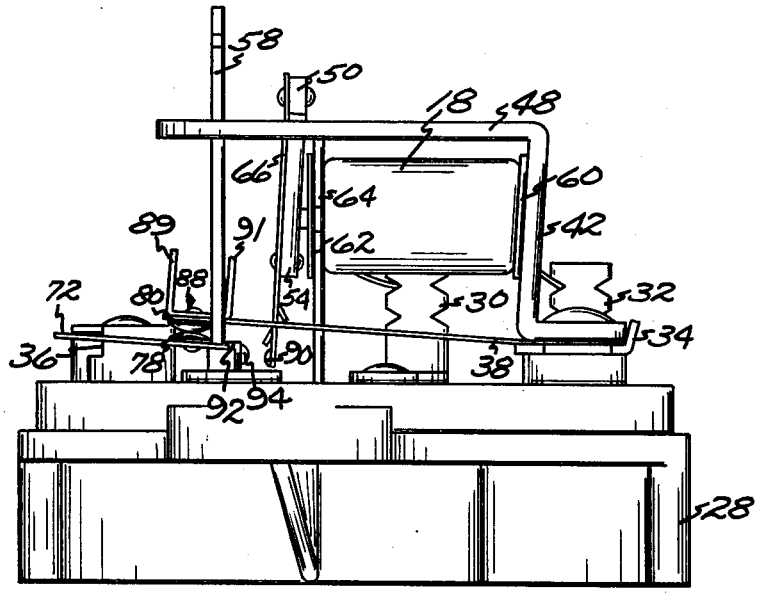
FIG. 5 is a view similar to FIG. 3 with the bypass switch contacts in the closed position and the interlock switch contacts in the open position.
Figure 6:
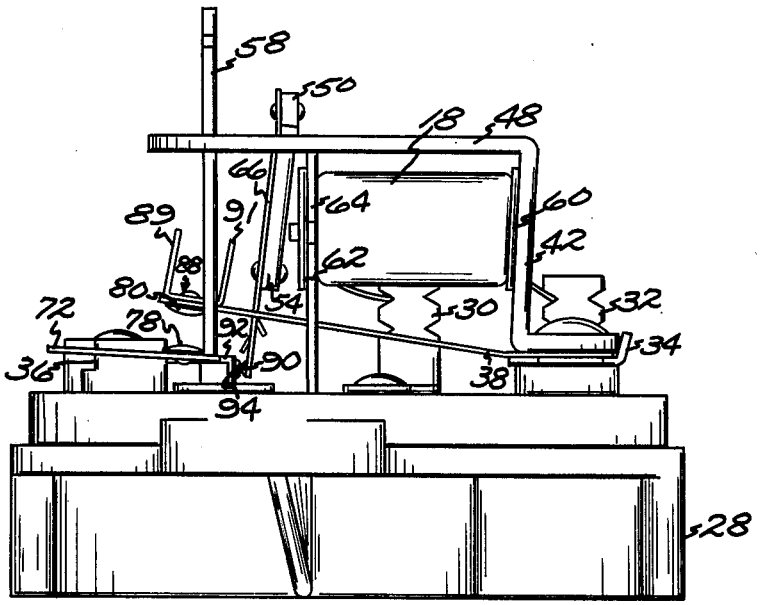
FIG. 6 is a view similar to FIG. 3 with the bypass switch contacts in the open position and the interlock contacts in the closed position.
Figure 11:
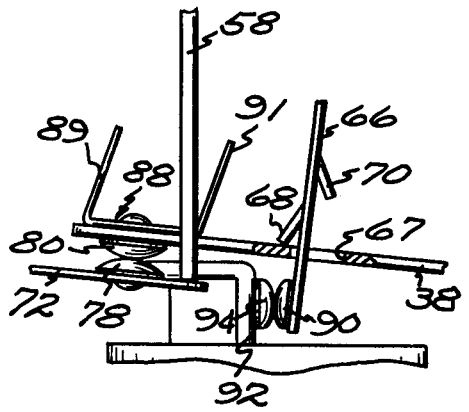
FIG. 11 is an enlarged cross-sectional view of the interlock and bypass contacts and the latching system employed in the relay of FIGS. 2–6.

Contacts 78, 80 as best shown in FIG. 11 of the bypass portion of the relay remain in engagement after being manually activated with the first latch 68 holding them there. However, upon energization of the coil 18 the clapper 54 and the latch spring 66 connected thereto move toward the coil 18 which causes unlatching of the first latch 68 and the subsequent latching of the second latch 70 on the opposite face of latch spring 66 as shown in FIG. 5. Spacing between the two latches must be such that the movable contact arm 38 will move only part of the distance between the latches in the time it takes the clapper 54 and latch spring 66 to move to the energized coil position. Upon deenergization of the coil movable contact arm 38 is freed from the second latch 70 and returns to its initial contacts open position as shown by FIG. 6.

Attached to the latch spring 66 on the lower front left corner as viewed in FIG. 3 from the coil looking toward the movable contact 80 of the bypass portion of the relay is the movable contact 90 of the interlock portion of the relay. This contact 90 as well as the other contacts used in this relay are conventionally made out of fine silver and may be rivoted to their respected support members. A stationary contact arm 92 of the interlock portion of the relay is attached to and extends from load terminal 36 to a position directly in front of the movable contact 90 of the interlock portion of the relay so that a stationary contact 94 attached to arm 92 will be in engagement with the movable contact 90 when the latch spring 66 is situated in the deenergized coil position. Normally closed contacts 90, 94 provide the interlock portion of the relay.

Upon trying to start the car if the seat belts have been fastened properly, the interlock logic module will not sent a signal to energize the coil and the current will flow from the ignition-start switch 12 into load terminal 34 through frame 40 to latch spring 66 to interlock movable contact 90 to stationary contact 94 through the stationary contact arm 92 to load terminal 36 and on to start relay. The car can then be started. However, if the seat belts have not been fastened properly, the interlock module will send a signal to energize the coil which causes the interlock contacts to open so the car can not be started. The bypass portion of the relay can be activated to allow the car to be started. The button 26 is pushed and bypass contacts 78, 80 are brought into engagement. The current path now is from the ignition start switch 12 into load terminal 34 through bypass movable contact arm 38 to movable contact 80 to stationary contact 78 through bypass stationary contact arm 72 to load terminal 36 and on to start relay 14. The car once again can be started but upon turning off the ignition the bypass contacts will go back to open position.

Thus it will be seen that the invention advantageously provides a relay which incorporates the functions of both an interlock relay and a bypass relay in a single device.

Figure 13:
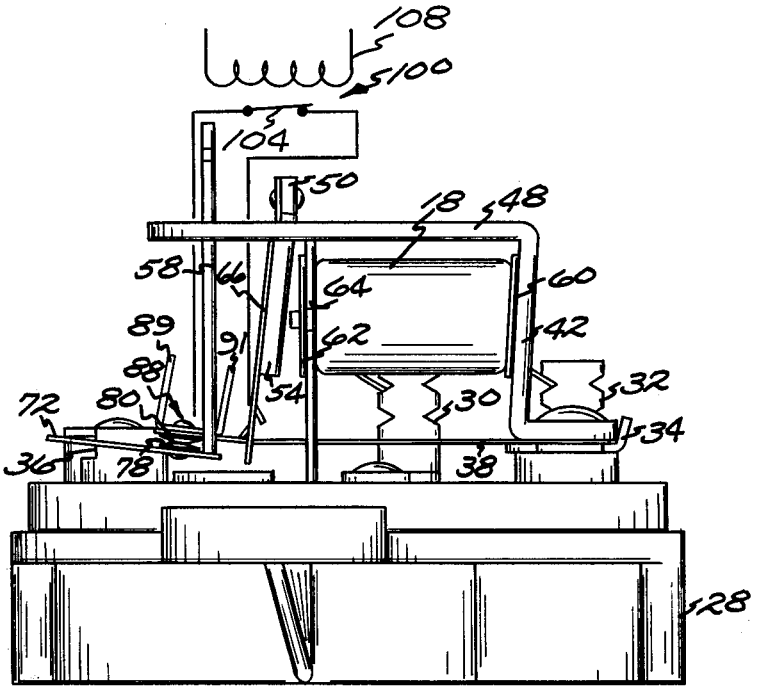
FIG. 13 is a view similar to FIG. 3 of a second embodiment of this invention.
Figure 14:
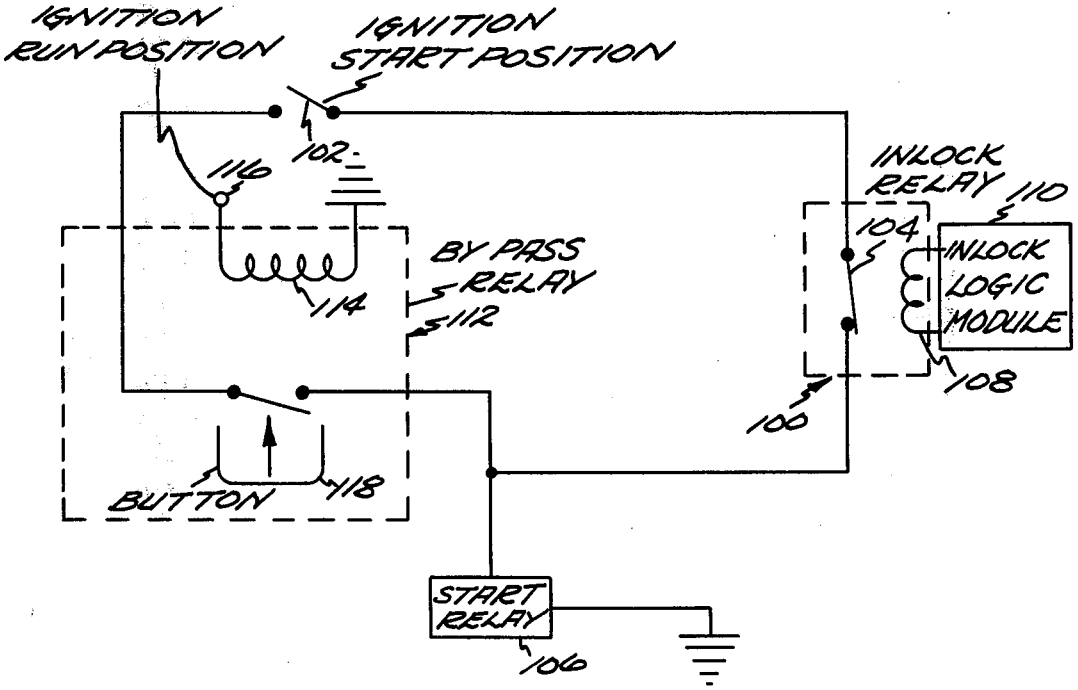
FIG. 14 is an electrical schematic diagram illustrating a system in which the second embodiment of this invention may be employed.

As shown in FIG. 13 an alternate embodiment of this invention is shown in which the interlock contact assembly is replaced with a separate external interlock relay 100 comprising a normally closed switch 104 and a coil 108 serially connected to an interlock logic module 110 and electrically connected in parallel with the above device. The electrical schematic shown in FIG. 14 and compared to FIG. 1 is slightly altered by the two relay system but the two relay system functions in the same manner as the single relay system. Current will run from the ignition start position 102 through the normally closed contacts 104 of the interlock relay to the start relay 106 provided the interlock logic module 110 does not sense improper seat belt operation and open the contacts 104. If the contacts 104 are opened then the only way to energize the system is to manually actuate the bypass relay 112 by button 118. The coil 114 of the bypass relay 112 is energized when the ignition is in run position 116 so when the car is turned off the bypass relay 112 will return to the contacts open position.

Although the present invention has been and is illustrated in terms of specific preferred embodiments, it will be apparent that changes and modifications are possible without departing from the spirit and scope of the invention as defined in the appended claims.

I claim:

1. A manually set magnetic interlock bypass relay comprising:

a. a base;

b. electrical interlock switch means mounted on said base operatively connectable in a load circuit;

c. electromotive force generating means including an electromagnetic coil operatively connected to the electrical interlock switch means for opening the load circuit upon energization of the coil;

d. bypass switch means mounted on said base connected in parallel with said electrical interlock switch means including a movable contact arm and a relatively stationary contact arm in overlaying relationship for movement in and out of electrical contact to close and open a circuit through the bypass switch means;

e. latch means operatively engageable with the movable contact arm of the bypass switch means for holding said movable arm in a first and second latched position inn contact with the stationary arm of the bypass switch means;

f. the electromotive force generating means also being operatively coupled to the latch means of the bypass switch means for moving the latch means from a first latched position to a second and then to an unlatched position; and g. manually operable actuator means engageable with the movable contact arm of the bypass switch means for moving the movable arm into the first latch position.

2. A manually set magnetic interlock bypass relay as defined in claim 1 wherein the latch means includes a latch spring with a first and second latch.

3. A manually set magnetic interlock bypass relay as defined in claim 1 in which the interlock switch means includes an interlock stationary contact mounted on said base, the latch means including a clapper arm and latch spring operatively connected with the coil of the force generating means, and a movable contact mounted on the latch spring which moves into and out of engagement with said stationary contact in response to energization and deenergization of the coil.

4. A manually set magnetic interlock bypass relay as defined in claim 3 wherein the manually operable actuator means includes a button and slide, the slide anchored in the button, said slide has a notched portion which engages said movable contact arm of the bypass switch means to move the arm to the first latch position and the slide also has two legs adapted to engage the stationary contact arm of the bypass switch means, the stationary contact arm of the bypass switch being movable whereby electrical contact between the movable and stationary contact is prevented when the button is depressed to effect trip-free operation of the relay.

5. A manually set magnetic bypass relay comprising:

a. a bypass switch means operatively connectable to a load circuit including a movable contact arm and a relatively stationary contact arm in overlying relationship for movement in and out of electrical contact to close and open a circuit through the switch means;

b. latch means operatively engageable with the movable contact arm for holding said movable arm in a first and second latched position in contact with the stationary arm;

c. an electromotive force generating means operatively coupled to the latch means for moving the latch means from the first latched position to the second and then to an unlatched position; and d. a manually operable actuator means engageable with the movable contact arm for moving said arm into the first latched position.

6. A manually set magnetic bypass relay as defined in claim 5 wherein the latch means includes a latch spring with a first and a second latch.

7. A manually set magnetic bypass relay as defined in claim 6 wherein the manually operable actuator means includes a button and a slide, the slide anchored in the button, said slide has a notched portion which engages said movable contact arm of the bypass switch means to move the arm to the first latch position and the slide also has two legs adapted to engage the stationary contact arm of the bypass switch means, the stationary contact arm of the bypass switch being movable whereby electrical contact between the movable and stationary contact is prevented when the button is depressed to effect trip-free operation of the relay.

8. A manually set magnetic bypass relay comprising:

a. a bypass switch means operatively connectable to a load circuit including a movable contact arm having a slot therein and a relatively stationary contact arm wherein the movable contact arm is in overlying relationship with the stationary contact arm for movement in and out of electrical contact to close and open a circuit through the switch means;

b. latch means operatively engageable with the movable contact arm and extending through the slot for holding said movable arm in a first and second latched position in contact with the stationary arm;

c. an electromotive force generating means operatively coupled to the latch means for moving the latch means from the first latched position to the second and then to an unlatched position; and d. a manually operable actuator means engageable with the movable contact arm for moving said arm into the first latched position.

9. A latching system comprising:

a. relatively stationary contact means;

b. a movable contact arm having a slot therein, a movable contact mounted on said arm in overlying relation to said relatively stationary contact means for movement in and out of electrical contact with said contact means;

c. latch means extending through said slot with a first latch position, a second latch position, and an unlatched position;

d. force generating means operatively coupled to the latch means for moving said latch means from the first latch position to the second latch position and unlatched position.

10. A latching system as defined in claim 9 wherein the latch means includes a latch spring, said latch spring having a first latch and a second latch cut therefrom.

11. A latching system as defined in claim 10 wherein the force generating means is a coil.

12. A latching system as defined in claim 11 further including manually operable actuator means engageable with the movable contact arm for moving the arm into the first latch position.

13. A latching system comprising:

a. relatively stationary contact means;

b. a movable contact arm having a slot therein, a movable contact mounted on said arm in overlying relation to said relatively stationary contact means for movement in and out of electrical contact with said contact means;

c. latch means extending through said slot including a latch spring, said latch spring having a first latch and a second latch cut therefrom to provide a first latch position and a second latch position;

d. a coil operatively coupled to the latch means for moving said latch means from the first latch position to the second latch position; and e. manually operable actuator means including a button and a slide, the slide anchored in the button, said slide has a notched portion which engages said movable contact arm to move the arm to the first latch position and the slide also has two legs adapted to engage the relatively stationary contact means; the relatively stationary contact means being movable whereby electrical contact between said stationary contact means and said movable contact is prevented when the button is depressed to effect trip-free operation of the relay.

* * * * *